United States Patent [19]

Hornbostel

[11] Patent Number: 4,921,246

[45] Date of Patent: May 1, 1990

[54] FLEXIBLE BARBELL BAR

[76] Inventor: Richard W. Hornbostel, N53 W34228 Rd. Q, P.O. Box 452, Okauchee, Wis. 53069

[21] Appl. No.: 365,041

[22] Filed: Jun. 12, 1989

[51] Int. Cl.[5] ..... A63B 21/072

[52] U.S. Cl. ..... 272/123

[58] Field of Search ..... 272/67, 68, 117, 122, 272/123, 143

[56] References Cited

U.S. PATENT DOCUMENTS

| | | | |
|---|---|---|---|
| 2,356,260 | 8/1944 | Maxwell | 272/123 X |
| 4,557,479 | 12/1985 | Guibert | 272/117 X |
| 4,690,399 | 9/1987 | Hayashi | 272/68 X |
| 4,691,915 | 9/1987 | Sutton | 272/68 |
| 4,702,474 | 10/1987 | Guibert | 272/117 X |
| 4,720,096 | 1/1988 | Rogers | 272/123 X |

*Primary Examiner*—Robert W. Bahr

[57] ABSTRACT

A barbell having a flexible break. The flexibility in the break is caused by the bar being held together with steel cable. This flexibility allows the barbell to change form, depending on how it is held and the exercise being performed.

1 Claim, 1 Drawing Sheet

FLEXIBLE BARBELL BAR

BACKGROUND OF INVENTION

1. Field of the Invention

The invention relates to a device used in progressive weight training for the purposes of muscular development and a shaping of the body.

2. Description of Prior Art

Up until this time many different devices were needed to perform a variety of different exercises. The invention is a single weight training device that can take the place of many. It can be used as a barbell, dumbell or wrist/twist bar. You can do crusher movements for the chest and Iron Shoe movements for the legs. All this is done without any dismantling of the bar. The invention can also be used as a calf machine. The basis of a calf machine is to allow your hands and arms freedom to balance your body beneath a weight during the performance of standing toe raises. The invention will remain safely on your shoulders without any need for your hands or arms to balance it, enabling you to use your arms for support. This support also allows for the performance of weighted sissy squats. Bodybuilders cannot do sissy squats with an ordinary barbell because they need at least one arm free to balance the body. Both arms will be free with the Flexible Break Barbell. With this freedom, forced reps (an advanced technique) are possible in many standing leg exercises by pulling with the arms as you push with the legs. (This is impossible with an ordinary barbell.) With an ordinary barbell you must increase the weight on the bar to increase resistance when performing the same exercise. You may also do this with the invention, but there is an added advantage when using the arms in an exercise (most upper body exercises are done using the arms). You may change resistance by moving between a narrow, medium or wide grip, thereby changing the angle of the break and changing resistance by increasing or decreasing leverage. This saves time and the bodybuilder does not lose intensity in the working muscles while changing weights. For convenience the invention may be folded and placed in a suitcase or closet. The invention is the most versatile barbell known at this time.

SUMMARY OF INVENTION

The invention relates to a device for progressive weight training for the purposes of muscular development and a shaping of the body. It is comprised of a barbell that has a flexible break in the middle, which vastly improves flexibility, efficency, and variety of use.

The object of the invention is to provide one inexpensive weight training device that can replace many, without any dismantling of the bar, while still providing for a full body workout, with superior variety of leverage, all done in a small amount of space with convenient fold-up for storage.

DESCRIPTION OF THE PREFERRED EMBODIMENT

Figure 1:
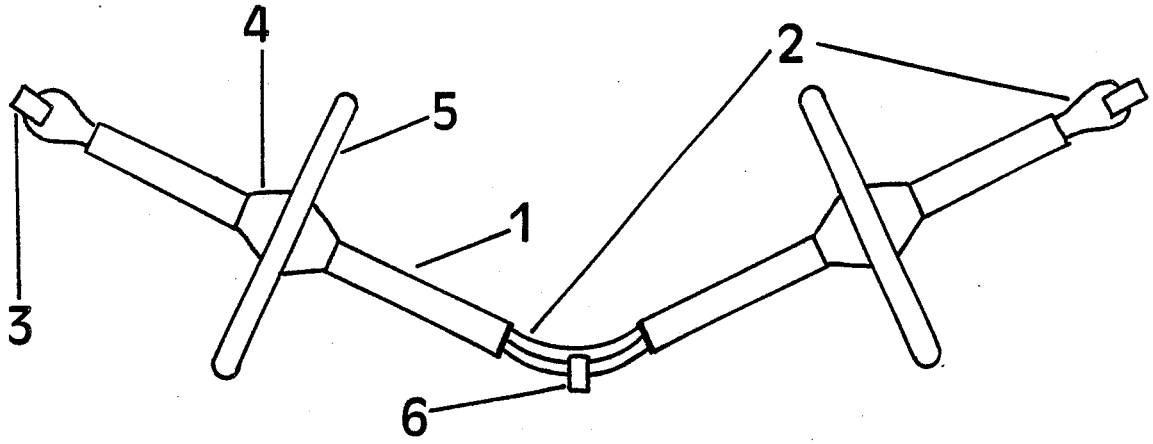
FIG. 1 shows the barbell ready for use, complete with standard collars and weight plates.
Figure 2:
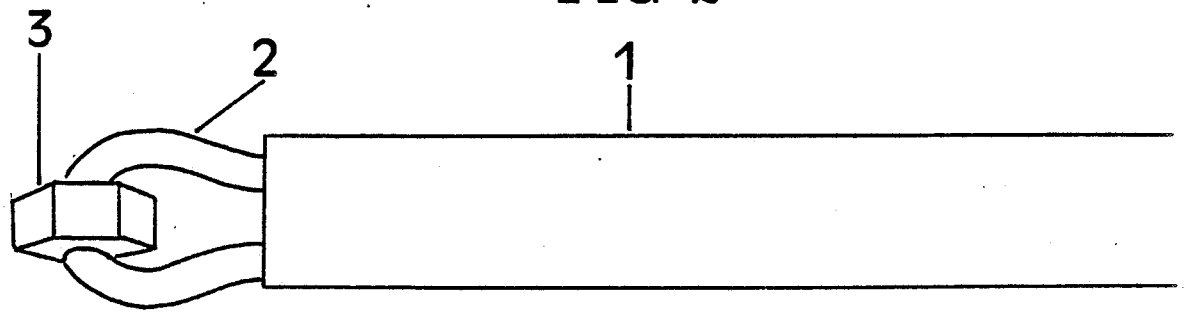
FIG. 2 is a full size view of the end section of the barbell.
Figure 3:
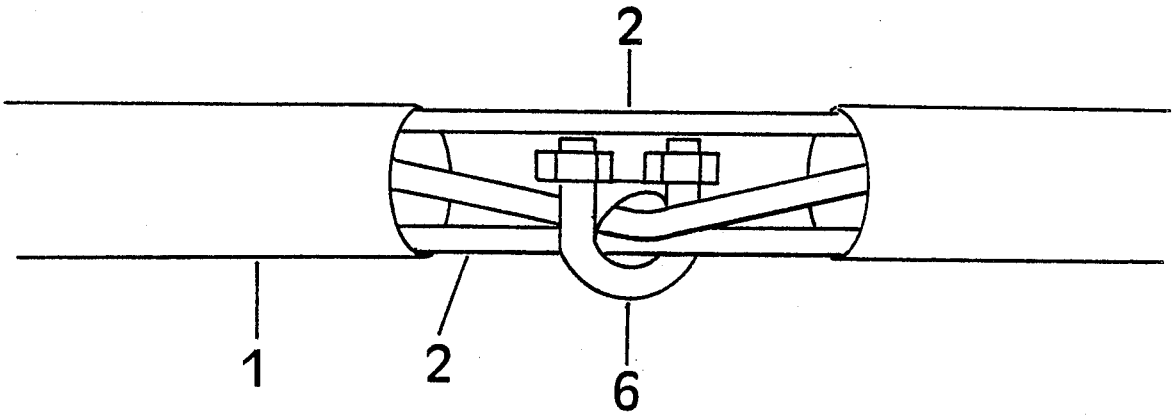
FIG. 3 is a full size view of the middle section of the barbell.

Referring to FIG. 1. Two $\frac{3}{4}''$ steel pipe of equal length 1 are placed end to end on a flat surface. $\frac{1}{4}''$ steel cable 2 is run through the pipes. The cable length must be double the length of the two pipes, plus at least 12". Example: Length of both pipes end to end is 36". Double this amount, which is 72". Add at least 12" more. The minimum total length of the cable is 84". After you have run the cable through the two pipes, make sure the cable is sticking out an equal distance on each end. Now slip a $\frac{7}{8}''$ (total width) cable stop 3 onto each end of the cable. Slide them down to meet the pipe. (The cable stops will prevent the weight of the collars 4 and plates 5 from pulling the cable through the pipe.) Loop each end of the cable back through the end of each pipe FIG. 2 until they come out between the pipes. The cable should now be adjusted so that approximately 3" can be seen between the pipes. Now place the cable clamp 6 on the two sections of cable that you have just pulled back through the pipes. See FIG. 3. Pull cable tight until the cable stops on each end meet the pipe. Shove ends of cable into opposite pipe and secure clamp. When slipping collars or weights on or off the barbell the cable stop should be in a horizontal position FIG. 2.

To use the invention as any type of barbell, grip it with both hands, each hand the same distance from the break. The width of your grip can range anywhere from a hand on each side of the break to a hand at each end of the bar (outside the weights and collars). The width of your grip will determine the leverage you have as the split bar will change in degree of angle from the break.

To use a dumbell simply grip the invention with one hand on either side of the break, half way between the break and inside collar. Then perform your exercise. (One half of the flexible barbell will be hanging down vertically.) Be sure collars are secure.

To use the invention for upright squats (heavy bent over squats will put too much pressure on the neck as the weight will not be balanced) and standing toe raises, lift the barbell over your head and place the break behind the neck, making sure that the cable clamp is pointed away from the neck. Let the weight plates rest on each side of your chest. The weight will balance itself and your arms are free to balance the body or help with forced reps.

To use as a wrist/twist bar hold the invention at arms length or at a half curl position with both hands, then twist back and forth. One hand will be twisting forward as the other is twisting backward.

To use as a crusher device, hold the invention either with straight arms or in a half curl position, then using only shoulder and chest muscles bend the barbell.

To perform Iron Shoe exercises, hook an ankle strap on the loop at one end of the barbell. Slip one foot through it, holding the other end of the barbell with either your left or right hand (whichever is best for the leg exercise you are performing). Use your free arm for support. For the fullest range of movement in each exercise, the height of your grip on the barbell may vary.

I claim:

1. A flexible barbell comprising:

two equal sections of steel pipe, each pipe section having a weight receiving end and a central end, said weight receiving ends having removable barbell disk retaining collars;

a steel cable strung through both pipe sections such that the cable forms loops at the weight receiving end of each pipe section, and the cable ends extend from the central end of each pipe section;

a ring on each cable loop such that the cable is prevented from slipping through the pipe, said ring being dimensioned such that a barbell disc may pass over the ring and onto the weight receiving end of the barbell; and, a clamp connecting the cable ends together such that a space is formed between the pipe sections to allow the user to hold and use the barbell in a variety of configurations.

* * * * *